US011534818B2

(12) United States Patent
Maeda et al.

(10) Patent No.: US 11,534,818 B2
(45) Date of Patent: Dec. 27, 2022

(54) METHOD FOR MANUFACTURING DOUBLE-PIPE HEAT EXCHANGER

(71) Applicant: NICHIRIN CO., LTD., Hyogo (JP)

(72) Inventors: Ryuichi Maeda, Himeji (JP); Takashi Yagi, Himeji (JP); Koichi Mori, Himeji (JP)

(73) Assignee: NICHIRIN CO., LTD., Hyogo (JP)

( * ) Notice: Subject to any disclaimer, the term of this patent is extended or adjusted under 35 U.S.C. 154(b) by 0 days.

(21) Appl. No.: 17/775,156

(22) PCT Filed: May 19, 2020

(86) PCT No.: PCT/JP2020/019822

§ 371 (c)(1),
(2) Date: May 6, 2022

(87) PCT Pub. No.: WO2021/090526

PCT Pub. Date: May 14, 2021

(65) Prior Publication Data

US 2022/0347737 A1 Nov. 3, 2022

(30) Foreign Application Priority Data

Nov. 7, 2019 (JP) ..... JP2019-202543

(51) Int. Cl.
*B21D 53/06* (2006.01)
*F28D 7/10* (2006.01)

(52) U.S. Cl.
CPC ..... *B21D 53/06* (2013.01); *F28D 7/10* (2013.01)

(58) Field of Classification Search
CPC ..... B21D 53/06; F28D 7/10
See application file for complete search history.

(56) References Cited

U.S. PATENT DOCUMENTS

2006/0096314 A1* 5/2006 Nakamura ..... F25B 40/00 138/114
2006/0096744 A1 5/2006 Nakamura et al.
(Continued)

FOREIGN PATENT DOCUMENTS

CN 104704311 A * 6/2015 ..... F25B 40/00
JP S48-034663 B1 10/1973
(Continued)

OTHER PUBLICATIONS

International Search Report issued in PCT/JP2020/019822 dated Aug. 11, 2020 (2 pages).
(Continued)

*Primary Examiner* — Emmanuel E Duke
(74) *Attorney, Agent, or Firm* — Osha Bergman Watanabe & Burton LLP

(57) ABSTRACT

A method includes: an inner pipe insertion step of inserting an inner pipe to between a cored bar and a metal movable claw; a designated section corrugated portion formation step of forming a corrugated portion in a first designated section by pressing the first designated section of the inner pipe radially inward by the metal movable claw and plastically deforming the first designated section; a movable claw moving step of moving the metal movable claw outward in the radial direction of the inner pipe; and an inner pipe moving step of moving a second designated section that is the next designated section to between the cored bar and the metal movable claw.

4 Claims, 13 Drawing Sheets

(56) References Cited

U.S. PATENT DOCUMENTS

| | | | | |
|---|---|---|---|---|
| 2006/0112556 | A1 | 6/2006 | Nakamura et al. | |
| 2011/0073208 | A1* | 3/2011 | Nakamura | F16L 9/18 138/114 |
| 2014/0109373 | A1* | 4/2014 | Nakamura | F28F 1/06 29/428 |

FOREIGN PATENT DOCUMENTS

| | | | | |
|---|---|---|---|---|
| JP | S63-076715 | A | | 4/1988 |
| JP | 2005-144459 | A | | 6/2005 |
| JP | 1628858 | B2 | | 2/2011 |
| JP | 2016099075 | A | * | 5/2016 |
| JP | 2017026248 | A | * | 2/2017 |
| WO | 2012/000490 | A2 | | 1/2012 |
| WO | WO-2019150968 | A1 | * | 8/2019 |

OTHER PUBLICATIONS

Written Opinion of the International Searching Authority issued in PCT/JP2020/019822 dated Aug. 11, 2020 (3 pages).
Decision to Grant issued in the counterpart Japanese Patent Application No. 2019-202543, dated Feb. 2, 2021 (5 pages).
International Preliminary Report on Patentability for corresponding International Application No. PCT/JP2020/019822, dated May 19, 2022 (5 pages).

* cited by examiner

METHOD FOR MANUFACTURING DOUBLE-PIPE HEAT EXCHANGER

TECHNICAL FIELD

The present invention relates to a method for manufacturing a double-pipe heat exchanger that includes an outer pipe (tube) and an inner pipe (tube) provided inside the outer pipe.

BACKGROUND ART

Patent Literature 1 recites a known method for manufacturing a double-pipe heat exchanger in which an inner pipe is provided inside an outer pipe and grooves are formed in a surface of the inner pipe to extend in a longitudinal direction.

These grooves are formed to increase the heat transfer area and improve efficiency in heat exchange. The grooves are formed by performing rolling by using a grooving tool.

CITATION LIST

Patent Literatures

[Patent Literature 1] Japanese Patent No. 4628858

SUMMARY OF INVENTION

Technical Problem

Patent Literature 1 described above is disadvantageous in that the manufacturing apparatus is expensive because the grooves must be formed by rolling. Furthermore, because the grooves are formed by rolling, the manufacturing must be continuous and takes a long time.

An object of the present invention is to provide a method for manufacturing a double-pipe heat exchanger, with which a corrugated portion for increasing a heat transfer area to improve efficiency in heat exchange is formed in a short time in a predetermined range in the axial direction of an inner pipe, by using an inexpensive manufacturing apparatus.

Solution to Problem

To achieve the object above, a method for manufacturing a double-pipe heat exchanger of the present invention is a method for manufacturing a double-pipe heat exchanger which includes an outer pipe and an inner pipe provided inside the outer pipe and which has a corrugated portion in which, in a transverse cross section of the inner pipe, outward protruding portions protruding radially outward and inward protruding portions protruding radially inward are alternately formed in a circumferential direction, the method comprising:

an inner pipe insertion step of inserting the inner pipe in an axial direction by a predetermined length to between (i) a cored bar which has at least one protrusion pointing radially outward at a position corresponding to a top portion of the corrugated portion and has a predetermined length in the axial direction and (ii) a metal movable claw which has at least one leading end protruding portion pointing radially inward at a position corresponding to a bottom portion of the corrugated portion, is radially movable, and has a predetermined length in the axial direction; and a corrugated portion formation step of forming the corrugated portion in a predetermined range of the inner pipe in the axial direction by pressing the inner pipe radially inward by the metal movable claw and plastically deforming the inner pipe.

Advantageous Effects

The method for manufacturing the double-pipe heat exchanger of the present invention includes:

an inner pipe insertion step of inserting the inner pipe in an axial direction by a predetermined length to between (i) a cored bar which has at least one protrusion pointing radially outward at a position corresponding to a top portion of the corrugated portion and has a predetermined length in the axial direction and (ii) a metal movable claw which has at least one leading end protruding portion pointing radially inward at a position corresponding to a bottom portion of the corrugated portion, is radially movable, and has a predetermined length in the axial direction; and a corrugated portion formation step of forming the corrugated portion in a predetermined range of the inner pipe in the axial direction by pressing the inner pipe radially inward by the metal movable claw and plastically deforming the inner pipe.

On this account, it is possible to form a corrugated portion for increasing a heat transfer area to improve efficiency in heat exchange in a short time in a predetermined range in the axial direction of an inner pipe, by using an inexpensive manufacturing apparatus having the cored bar and the metal movable claw.

In addition to the above, it is possible to manufacture the double-pipe heat exchanger without using an expensive inner pipe in which the corrugated portion is formed by extrusion. Being different from the inner pipe formed by extrusion, a part where the corrugated portion is not formed in the axial direction can be easily formed in the inner pipe of the present invention. On this account, the inner pipe can be easily and inexpensively fixed to the outer pipe.

In addition to the above, because the corrugated portion of the present invention is formed by using the cored bar and the metal movable claw, the corrugated portion is advantageously sharp in shape as compared to a case where the corrugated portion is formed by a hydraulic method that requires an expensive high-pressure pump.

BRIEF DESCRIPTION OF DRAWINGS

FIG. 1A shows a state before an inner pipe is inserted between a cored bar and a metal movable claw. FIG. 1B is a cross section cut along a line A-A in FIG. 1A. FIG. 1C illustrates a ridgeline of a leading end protruding portion of the metal movable claw shown in FIG. 1A. FIG. D is a view taken in the direction of an arrow Ib in FIG. 1C.

FIG. 2A shows a state in which the inner pipe (first designated section 3*a*) has been moved to between the cored bar and the metal movable claw. FIG. 2B is a cross section cut along a line B-B shown in FIG. 2A. FIG. 2C is a cross section cut along a line B-B in FIG. 2A and shows a state in which the inner pipe shown in the state of FIG. 2A is pressed radially inward by the metal movable claw. FIG. 2D is an enlarged view of a portion G shown in FIG. 2C. FIG. 2E shows a state in which the metal movable claw has been moved outward in the radial direction of the inner pipe from the state shown in FIG. 2C.

FIG. 3A shows a state in which the inner pipe (second designated section 3*b*) has been moved to between the cored bar and the metal movable claw. FIG. 3B is a cross section cut along a line C-C shown in FIG. 3A. FIG. 3C is a cross section cut along the line C-C in FIG. 3A and shows a state in which the inner pipe shown in the state of FIG. 3A is pressed radially inward by the metal movable claw. FIG. 3D is an enlarged view of a portion H shown in FIG. 3C. FIG. 3E shows a state in which the metal movable claw has been moved outward in the radial direction of the inner pipe from the state shown in FIG. 3C. FIG. 4A shows a state in which the inner pipe (third designated section 3*c*) has been moved to between the cored bar and the metal movable claw. FIG. 4B is a cross section cut along a line D-D shown in FIG. 4A. FIG. 4C is a cross section cut along the line D-D in FIG. 4A and shows a state in which the inner pipe shown in the state of FIG. 4A is pressed radially inward by the metal movable claw. FIG. 4D is an enlarged view of a portion I shown in FIG. 4C. FIG. 4E shows a state in which the metal movable claw has been moved outward in the radial direction of the inner pipe from the state shown in FIG. 4C. FIG. 5A shows a state in which both end portions of the outer pipe are fixed to axial outer circumferential portions. These axial outer circumferential portions are close to the both ends of a predetermined range of the inner pipe having the length L and are portions where a corrugated portion is not formed. FIG. 5B is a cross section cut along a line E-E in FIG. 5A. FIG. 5C is a cross section cut along a line F-F in FIG. 5A. FIG. 6A is a view for explaining a leading end protruding portion of a metal movable claw in a side view of the metal movable claw. FIG. 6B is a view taken in the direction of an arrow VIb shown in FIG. 6A. FIG. 6C is a view for explaining a state of a cross section cut along a line Vic-VIc shown in FIG. 6A. FIG. 6D is a view for explaining a state of a cross section cut along a line Vid-VId shown in FIG. 6A.

FIG. 7A is a view for explaining a leading end protruding portion of a metal movable claw in a side view of the metal movable claw. FIG. 7B is a view taken in the direction of an arrow VIIb shown in FIG. 7A.

FIG. 8A is a view for explaining a leading end protruding portion of a metal movable claw in a side view of the metal movable claw. FIG. 8B is a view taken in the direction of an arrow VIIIb shown in FIG. 8A.

DESCRIPTION OF EMBODIMENTS

The following will describe each step of a method for manufacturing a double-pipe heat exchanger of an embodiment of the present invention, with reference to FIGS. 1 to 5.

Figure 1A:
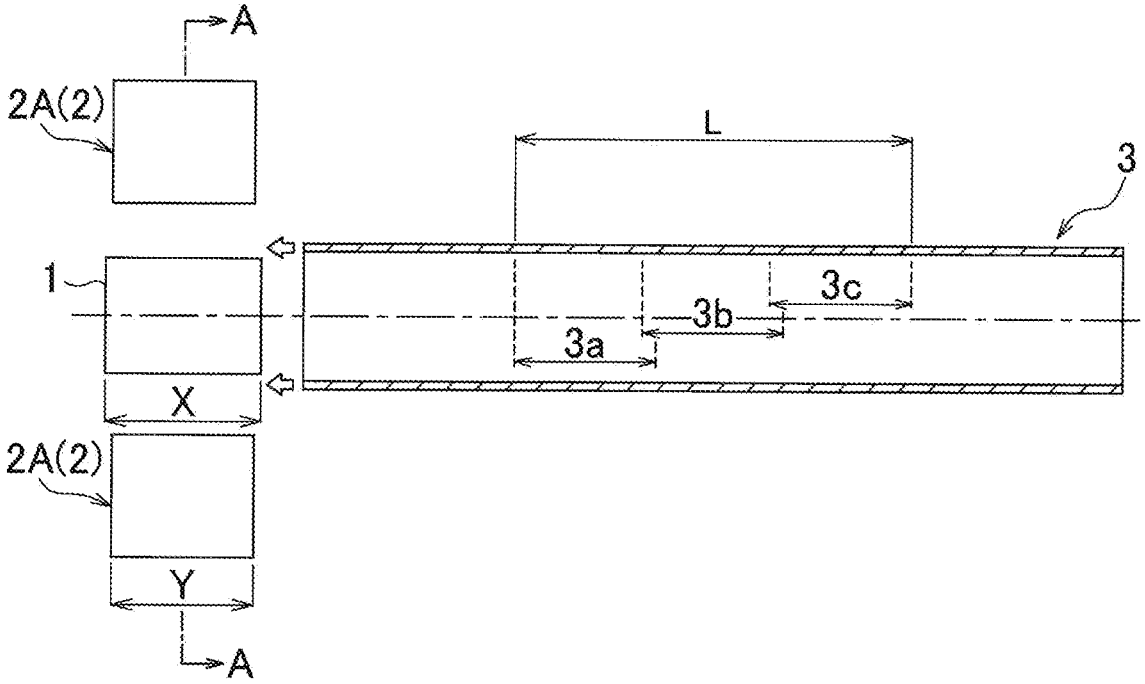
FIGS. 1A to 1D relate to a method for manufacturing a double-pipe heat exchanger of an embodiment.
Figure 1B:
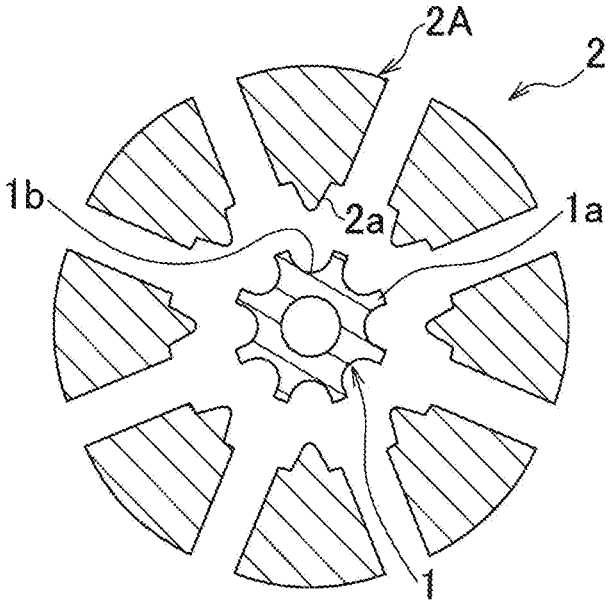
Figure 1C:
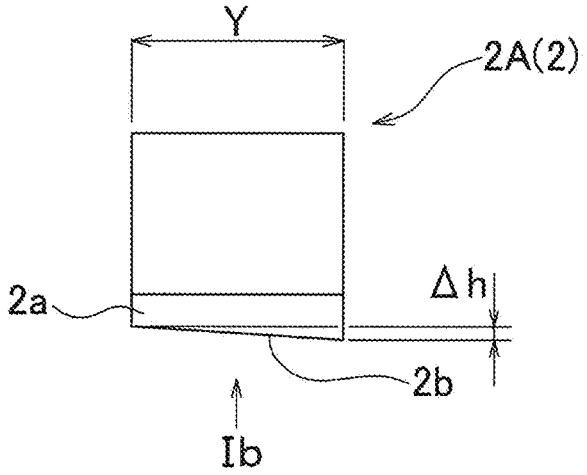

FIGS. 1A to 1D relate to a method for manufacturing a double-pipe heat exchanger of an embodiment. FIG. 1A shows a state before an inner pipe is inserted between a cored bar and a metal movable claw. FIG. 1B is a cross section cut along a line A-A in FIG. 1A. FIG. 1C illustrates a ridgeline of a leading end protruding portion of the metal movable claw shown in FIG. 1A. FIG. D is a view taken in the direction of an arrow Ib in FIG. 1C.

In FIG. 1A, a member 1 is a cored bar (detailed later) that is schematically shown and has a predetermined length in the axial direction, a member 2 is a metal movable claw (detailed later) that is schematically shown, is movable in the radial direction, and has a predetermined length Y in the axial direction, and a member 3 is an inner pipe (with, for example, an outer diameter of φ19). A length L is the length (e.g., about 160 mm) of a predetermined range in the axial direction of the inner pipe 3 where a corrugated portion 3*h* (described later and shown in FIG. 2) is to be formed. A section 3*a* is a first designated section that is a designated section in the predetermined range. A section 3*b* is a second designated section that is a designated section in the predetermined range. A section 3*c* is a third designated section that is a designated section in the predetermined range. In addition to them, L>X>Y=3*a*=3*b*=3*c*. The first designated section 3*a* and the second designated section 3*b* are neighboring sections and overlap with each other. The second designated section 3*b* and the third designated section 3*c* are neighboring sections and overlap with each other. The cored bar 1 is, for example, cantilevered.

In FIG. 1B, the cored bar 1 has eight protrusions 1*a* that are provided at equal intervals in the circumferential direction. Although not illustrated, each of the eight protrusions 1*a* extends in the axial direction of the cored bar 1. The metal movable claw 2 is separatable into eight metal movable claw pieces 2A that are eight equal pieces aligned in the circumferential direction. The metal movable claw 2 has eight leading end protruding portions 2*a* that are provided at equal intervals in the circumferential direction. One leading end protruding portion 2*a* is formed at one metal movable claw piece 2A. Each of the eight leading end protruding portions 2*a* extends in the axial direction of the metal movable claw 2 (see FIG. 1D). The leading end protruding portion 2*a* of the metal movable claw 2 is positioned to be equidistant from two neighboring protrusions 1*a* of the cored bar 1 in the circumferential direction. The protrusion 1*a* of the cored bar 1 protrudes radially outward at a position corresponding to a top portion 3*i* (described later and shown in FIG. 2E) of the corrugated portion 3*h*. The leading end protruding portion 2*a* of the metal movable claw 2 protrudes radially inward at a position corresponding to a bottom portion 3*j* (described later and shown in FIG. 2E) of the corrugated portion 3*h*.

The cored bar 1 may be made of die steel, for example. The metal movable claw 2 may also be made of die steel, for example. The inner pipe 3 may be made of, for example, pure aluminum, aluminum alloy, pure copper, copper alloy, or stainless steel.

Figure 1D:
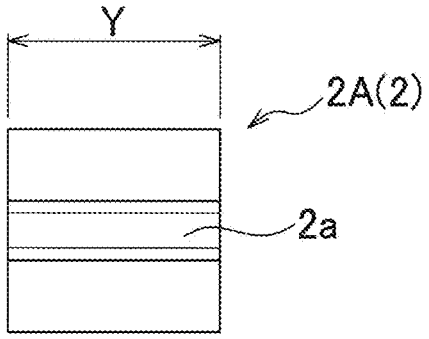

In FIG. 1C, a ridgeline 2*b* extending in the axial direction of the leading end protruding portion 2*a* of the metal movable claw 2 is slightly tilted relative to the axial direction. For example, the ridgeline 2*b* is tilted by Δh=50-200 μm toward the side from which the inner pipe 3 is inserted (i.e., rightward in FIG. 1C), relative to the length Y=50-100 mm of the metal movable claw 2 in the axial direction. It is noted that FIG. 1B does not show the tilt Δh of the ridgeline 2*b*. As shown in FIG. 1D, the leading end protruding portion 2*a* extends in the axial direction of the metal movable claw 2 (i.e., the left-right direction in FIG. 1D). The other leading end protruding portions 2*a* are structurally identical with the leading end protruding portions 2*a* shown in FIG. 1C and FIG. 1D.

(Inner Pipe Insertion Step)

Figure 2A:
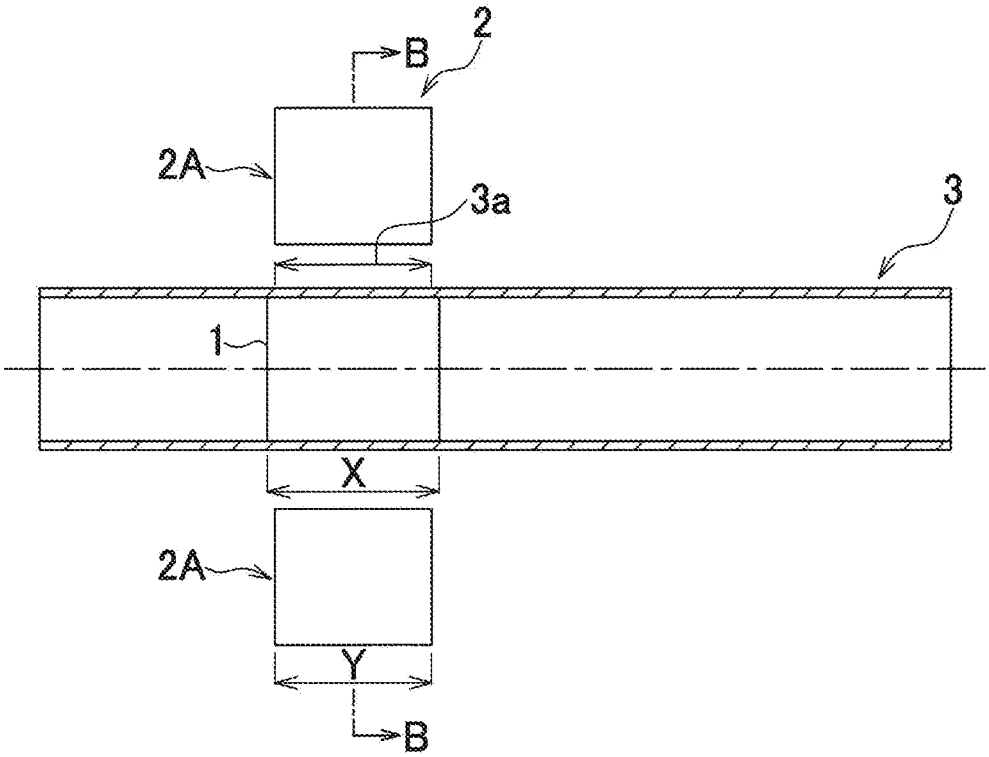
FIGS. 2A to 2E relate to the embodiment.
Figure 2B:
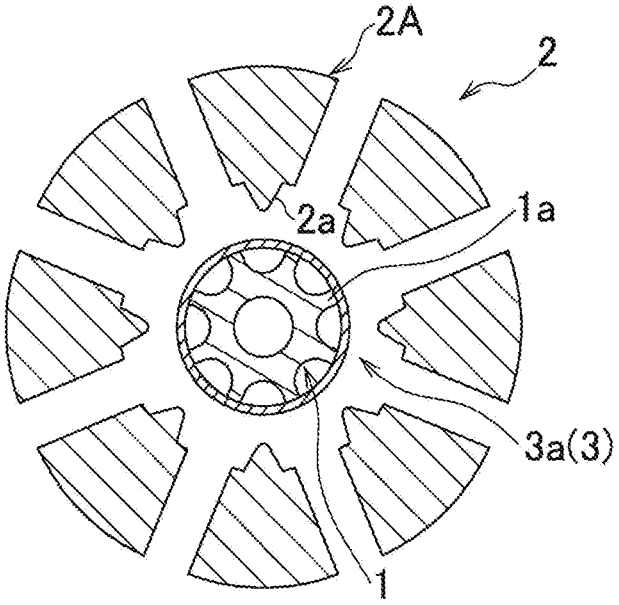

As shown in FIG. 2A, an inner pipe insertion step is a step of inserting the inner pipe 3 by a predetermined length in the axial direction to between the cored bar 1 and the metal movable claw 2. (For example, the inner pipe insertion step is the first step of moving the first designated section 3*a* to between the cored bar 1 and the metal movable claw 2.) FIG. 2B is a view for illustrating a cross section cut along a line B-B shown in FIG. 2A.

(Corrugated Portion Formation Step)

A corrugated portion formation step is a step for forming the corrugated portion 3*h* in the predetermined range with the length L of the inner pipe 3, by pressing the inner pipe 3 radially inward by the metal movable claw 2 and plastically deforming the inner pipe 3.

In the present embodiment, the corrugated portion 3*h* is formed in the entirety of the predetermined range having the length L in the inner pipe 3, through three successive groups of steps. These groups of steps will be described below one by one.

<Designated Section Corrugated Portion Formation Step 1>

Figure 2C:
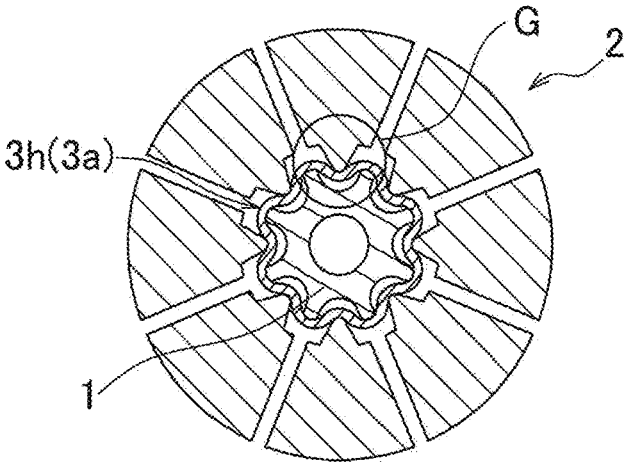

As shown in FIG. 2C, the corrugated portion 3*h* (3*a*) is formed in the first designated section 3*a* by pressing (e.g., by hydraulic pressure) the first designated section 3*a* of the inner pipe 3 radially inward by the metal movable claw 2 having the length Y in the axial direction and plastically deforming the first designated section 3*a* of the inner pipe 3.

Figure 2D:
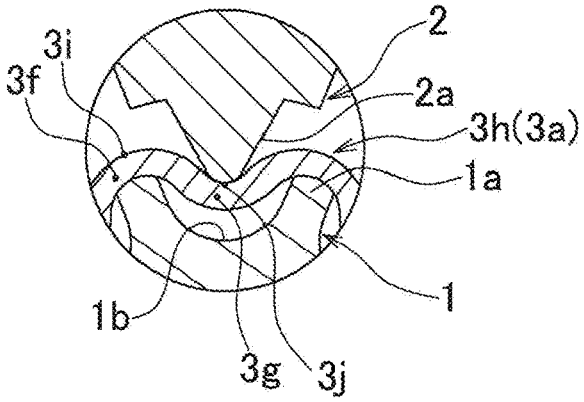

FIG. 2D is an enlarged view of the portion G shown in FIG. 2C. FIG. 2C and FIG. 2D show that, in a transverse cross section of the inner pipe 3, the corrugated portion 3*h* (3*a*) is arranged such that outward protruding portions 3*f* protruding radially outward and inward protruding portions 3*g* protruding radially inward are alternately formed in the circumferential direction.

<Movable Claw Moving Step 1>

Figure 2E:
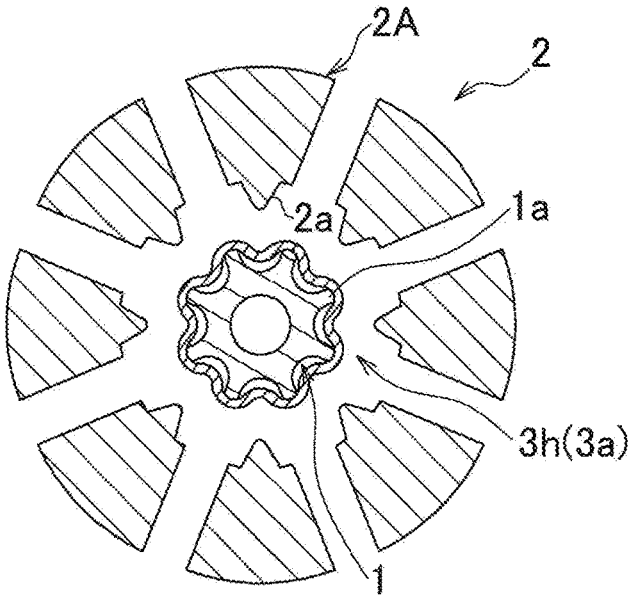

As shown in FIG. 2E, after the designated section corrugated portion formation step 1, the metal movable claw 2 having the designated length Y is moved radially outward of the inner pipe 3.

<Inner Pipe Moving Step 1>

Figure 3A:
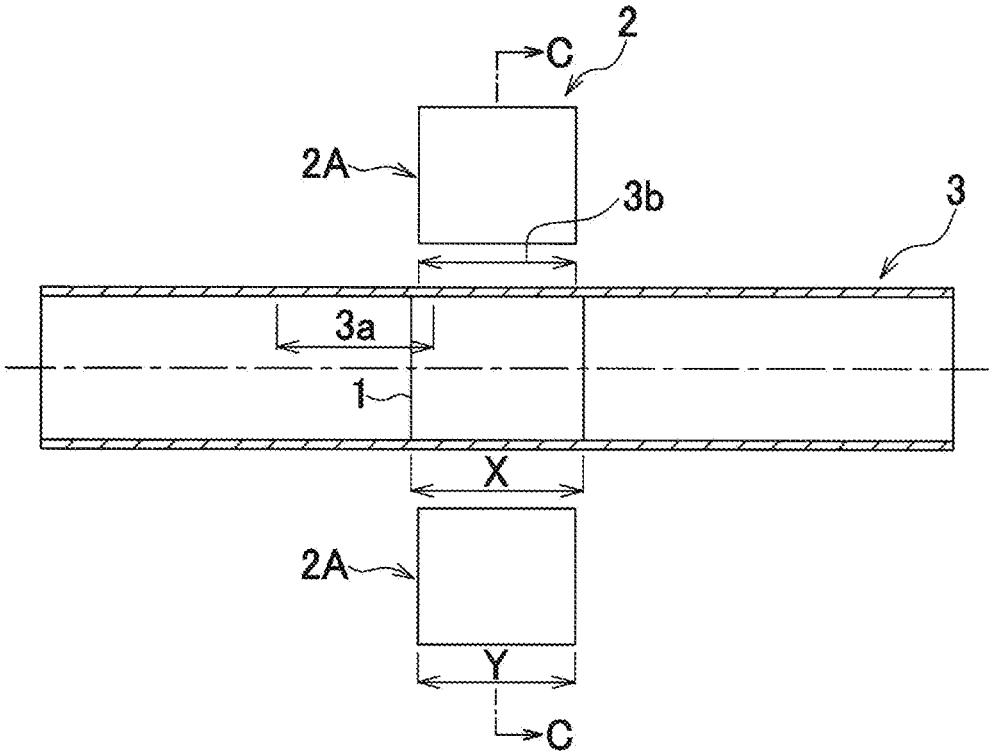
FIGS. 3A to 3E relate to the embodiment.
Figure 3B:
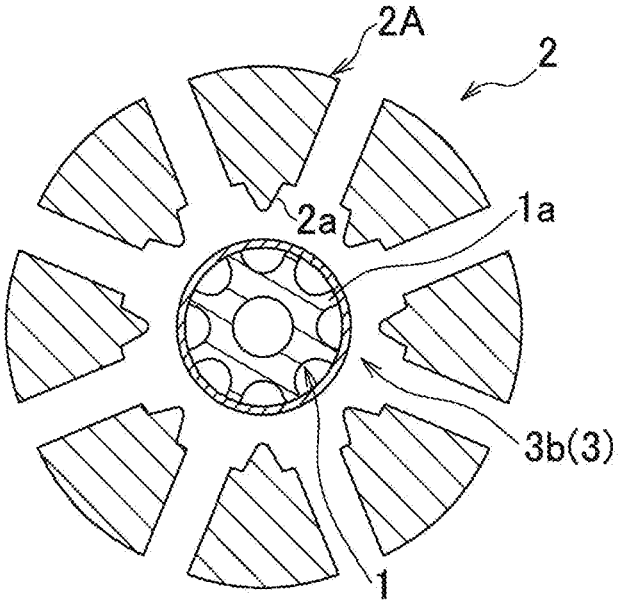

As shown in FIG. 3A, after the movable claw moving step 1, the second designated section 3*b* is moved to between the cored bar 1 and the metal movable claw 2 so that the section (second designated section 3*b*) designated next in the predetermined range with the length L of the inner pipe 3 overlaps the first designated section 3*a* of the designated section corrugated portion formation step 1 in the axial direction. FIG. 3B is a view for illustrating a cross section cut along a line C-C shown in FIG. 3A.

<Designated Section Corrugated Portion Formation Step 2>

Figure 3C:
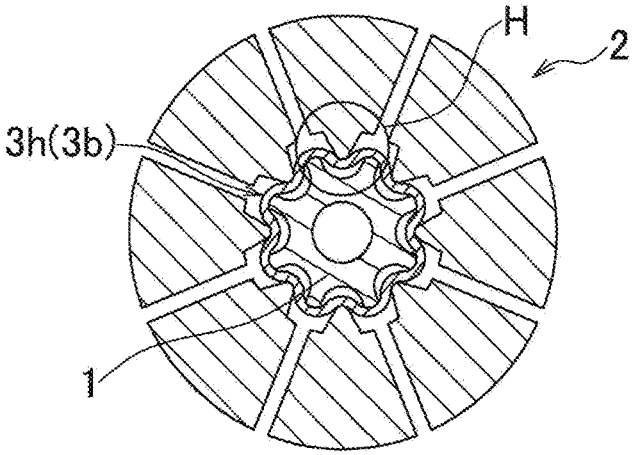

As shown in FIG. 3C, the corrugated portion 3*h* (3*b*) is formed in the second designated section 3*b* by pressing the second designated section 3*b* of the inner pipe 3 radially inward by the metal movable claw 2 having the length Y in the axial direction and plastically deforming the second designated section 3*b* of the inner pipe 3.

Figure 3D:
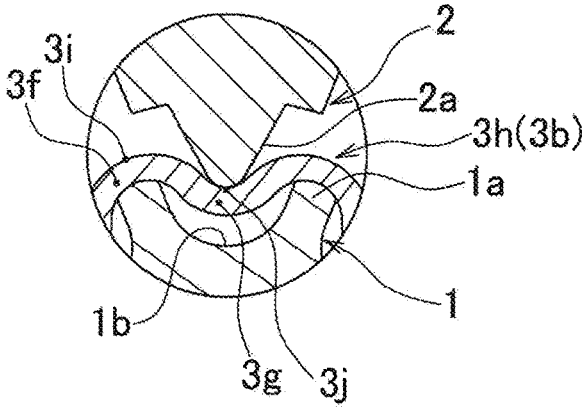

FIG. 3D is an enlarged view of the portion H shown in FIG. 3C. FIG. 3C and FIG. 3D show that, in a transverse cross section of the inner pipe 3, the corrugated portion 3*h* (3*b*) is arranged such that outward protruding portions 3*f* protruding radially outward and inward protruding portions 3*g* protruding radially inward are alternately formed in the circumferential direction.

<Movable Claw Moving Step 2>

Figure 3E:
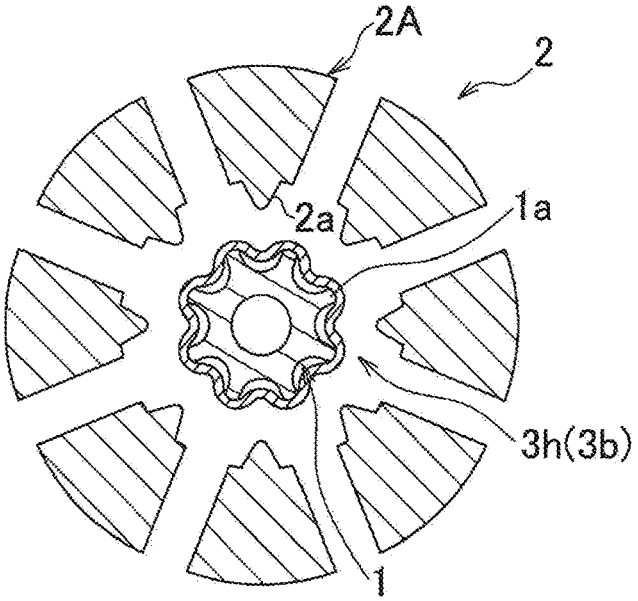

As shown in FIG. 3E, after the designated section corrugated portion formation step 2, the metal movable claw 2 having the designated length Y is moved radially outward of the inner pipe 3.

<Inner Pipe Moving Step 2>

Figure 4A:
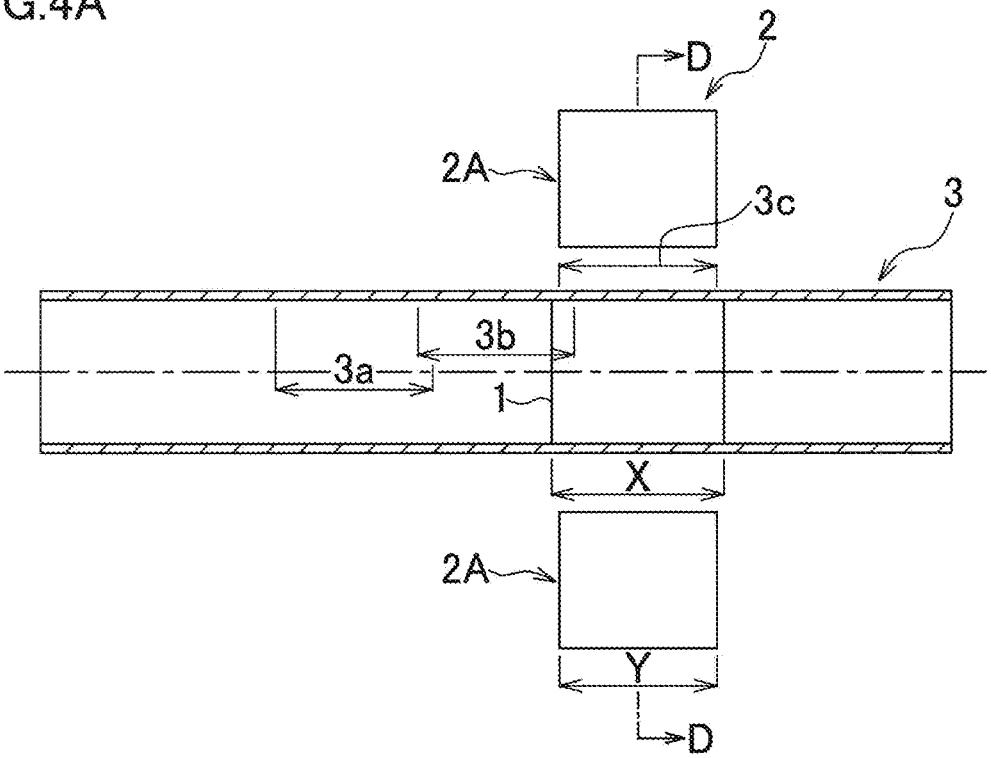
FIGS. 4A to 4E relate to the embodiment.
Figure 4B:
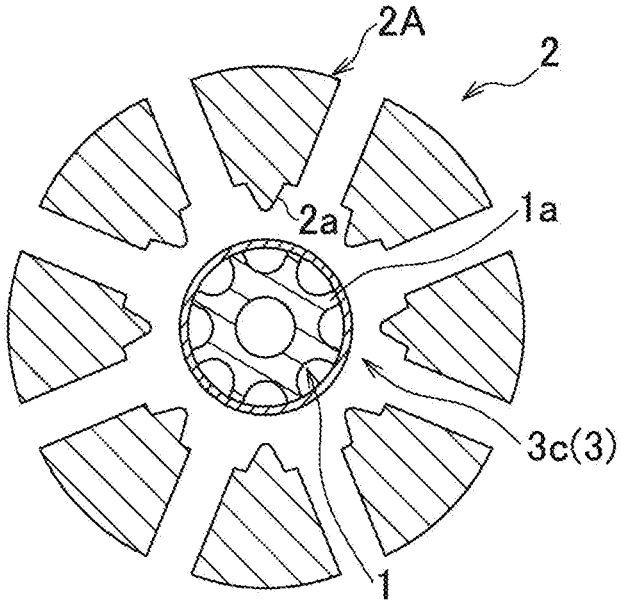

As shown in FIG. 4A, after the movable claw moving step 2, the third designated section 3*c* is moved to between the cored bar 1 and the metal movable claw 2 so that the section (third designated section 3*c*) designated next in the predetermined range with the length L of the inner pipe 3 overlaps the second designated section 3*b* of the designated section corrugated portion formation step 2 in the axial direction. FIG. 4B is a view for illustrating a cross section cut along a line D-D shown in FIG. 4A.

<Designated Section Corrugated Portion Formation Step 3>

Figure 4C:
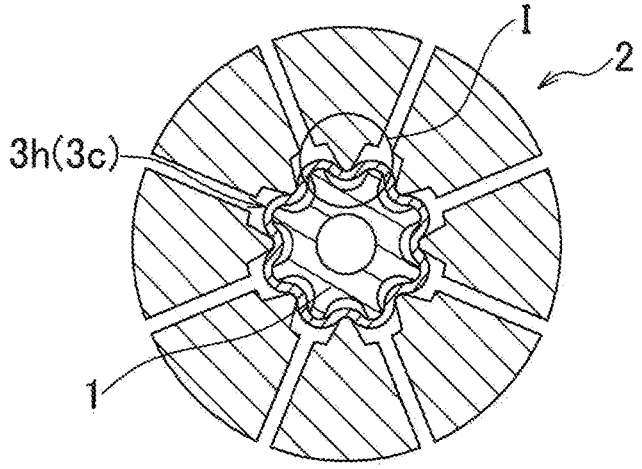

As shown in FIG. 4C, the corrugated portion 3*h* (3*c*) is formed in the third designated section 3*c* by pressing the third designated section 3*c* of the inner pipe 3 radially inward by the metal movable claw 2 having the length Y in the axial direction and plastically deforming the third designated section 3*c* of the inner pipe 3.

Figure 4D:
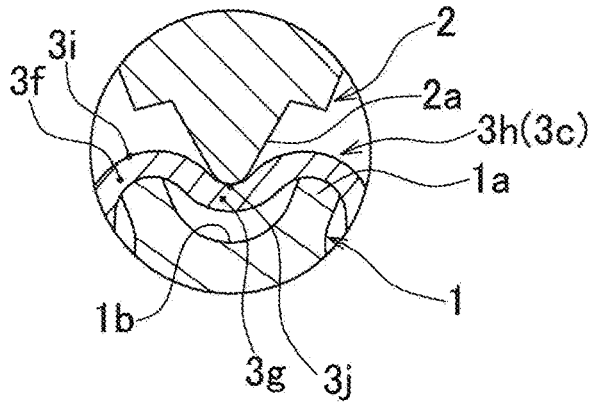

FIG. 4D is an enlarged view of the portion I shown in FIG. 4C. FIG. 4C and FIG. 4D show that, in a transverse cross section of the inner pipe 3, the corrugated portion 3*h* (3*c*) is arranged such that outward protruding portions 3*f* protruding radially outward and inward protruding portions 3*g* protruding radially inward are alternately formed in the circumferential direction.

<Movable Claw Moving Step 3>

Figure 4E:
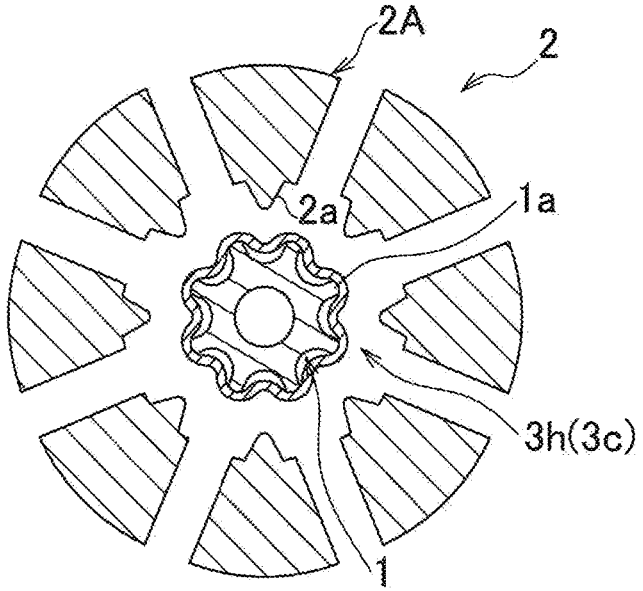

As shown in FIG. 4E, after the designated section corrugated portion formation step 3, the metal movable claw 2 having the designated length Y is moved radially outward of the inner pipe 3.

As a result of the steps above, the corrugated portion 3*h* is continuously formed in the entirety of the predetermined range having the length L of the inner pipe 3. According to the method for manufacturing the double-pipe heat exchanger of the present embodiment, because of the inclusion of the inner pipe insertion step and the corrugated portion formation step described above, the corrugated portion 3*h* that increases the heat transfer area to improve the efficiency in heat exchange can be formed in the predetermined range of the inner pipe 3 having the length L in the axial direction, even though the inexpensive manufacturing apparatus having the cored bar 1 and the metal movable claw 2 is employed. Furthermore, because the inner pipe 3 acquired by the method of the present embodiment is manufactured through the above-described steps, the manufacturing time is short as compared to the method using the rolling.

According to the present embodiment, the above-described corrugated portion formation step is arranged so that the following steps (1) to (3) are repeated in this order until the corrugated portion 3*h* is formed in the entirety of the predetermined range having the length L of the inner pipe 3.

(1) A designated section corrugated portion formation step of forming the corrugated portion 3*h* in a designated section (e.g., 3*a*) by pressing the designated section (e.g., 3*a*) in the predetermined range of the inner pipe 3 radially inward by the metal movable claw 2 having the designated length Y shorter than the length L of the predetermined range of the inner pipe 3 and plastically deforming the designated section (e.g., 3*a*).

(2) A movable claw moving step of moving, after the step (1), the metal movable claw 2 having the designated length Y radially outward of the inner pipe 3.

(3) After the step (2), an inner pipe moving step of moving the next designated section (e.g., 3*b*) to between the cored bar 1 and the metal movable claw 2 so that the section (e.g., 3*b*) designated next in the predetermined range of the inner pipe 3 overlaps the designated section (e.g., 3*a*) of the step (1).

As a result of these steps, the corrugated portion 3*h* is uninterruptedly and continuously formed in the entirety of the predetermined range having the length L of the inner pipe 3, in the axial direction.

The part where the current designated section (e.g., 3*a*) overlaps the next designated section (e.g., 3*b*) in the axial direction is pressed by the metal movable claw 2 in the current designated section corrugated portion formation step and the next designated section corrugated portion formation step. In other words, the overlapped part is pressed twice by the metal movable claw 2. As a result, at the overlapped part, a protrusion further protruding radially inward (a recess (not illustrated) when viewed from the outer surface of the inner pipe 3) is formed. At each of the part where the first designated section 3*a* and the second designated section 3*b* are overlapped and the part where the second designated section 3*b* and the third designated section 3*c* are overlapped, the protrusion is formed. These protrusions indicate that the corrugated portion 3*h* of the inner pipe 3 is formed by the method for the present embodiment, and not formed by another method (e.g., rolling).

As shown in FIG. 1C, the ridgeline 2*b* of the leading end protruding portion 2*a* of the metal movable claw 2 is tilted by Δh toward the side from which the inner pipe 3 is inserted (i.e., the right side in FIG. 1C). With this arrangement, each protrusion is more prominent at each of the part where the first designated section 3*a* and the second designated section 3*b* are overlapped and the part where the second designated section 3*b* and the third designated section 3*c* are overlapped. On this account, it is more evident that the corrugated portion 3*h* of the inner pipe 3 is formed by the method for the present embodiment, and not formed by another method (e.g., rolling).

As shown in FIG. 1B, the cored bar 1 has eight (even number of) protrusions 1*a* provided at equal intervals in the circumferential direction, and the metal movable claw 2 has eight (even number of) leading end protruding portions 2*a* provided at equal intervals in the circumferential direction. In this arrangement, as shown in FIG. 2B and FIG. 2C, two protrusions 1*a* provided on the opposite sides of the cored bar 1 in the radial direction about the axis protrude radially outward away from each other. Furthermore, two leading end protruding portions 2*a* provided on the opposite sides of the metal movable claw 2 in the radial direction about the axis protrude radially inward away from each other. With this arrangement, when the inner pipe 3 is pressed inward by the metal movable claw 2, the inner pipe 3 is pressed radially inward from the opposite sides by the two leading end protruding portions 2*a* that are provided on the opposite sides in the radial direction about the axis. On this account, the cross sectional shape of the inner pipe 3 is maintained to be substantially circular, while the corrugated portion 3*h* is formed on the inner pipe 3.

It is therefore possible to manufacture the inner pipe 3 that has the corrugated portion 3*h* and is substantially cylindrical in shape.

(Outer Pipe Fixation Step)

Figure 5A:
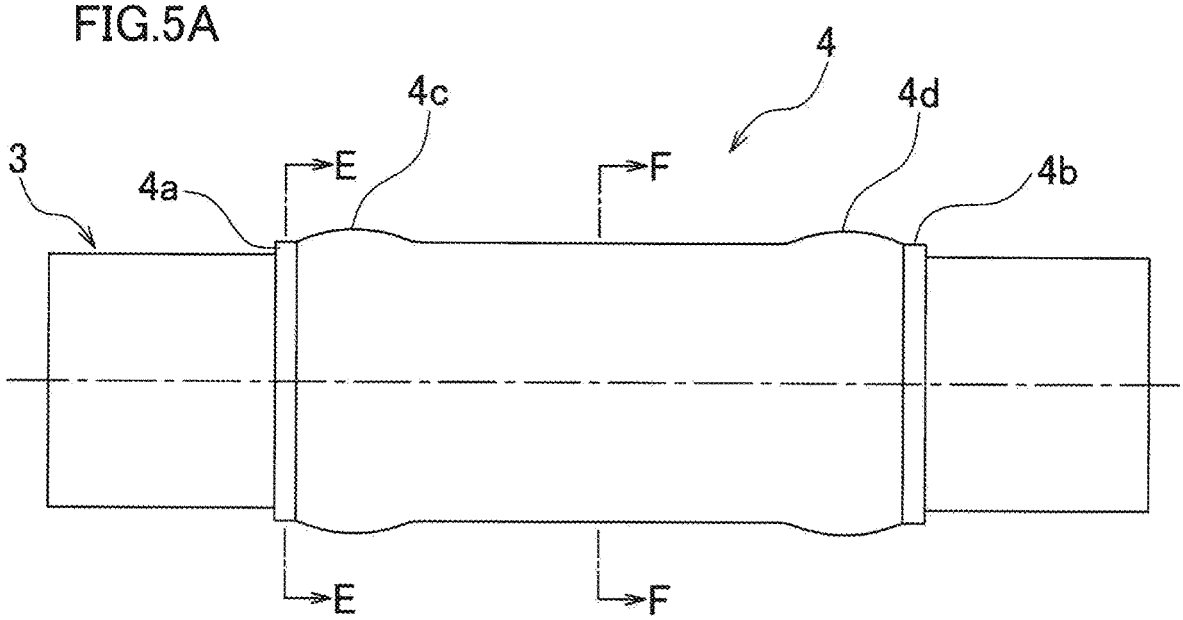
FIGS. 5A to 5C relates to the embodiment.

As shown in FIG. 5A, the outer pipe fixation step is a step in which, both end portions 4*a* and 4*b* of an outer pipe 4 (the outer diameter of the element pipe is, for example, φ22) are radially fastened to the outer circumferential portions of the inner pipe 3, which are in the vicinity of the ends of the predetermined range having the length L and where the corrugated portion 3*h* is not formed, and then the end portions 4*a* and 4*b* are brazed or welded so as to be fixed. At the both end portions 4*a* and 4*b* of the outer pipe 4, expanded pipe portions 4*c* and 4*d* are formed to be close to the respective end portions. Being similar to the inner pipe 3, the outer pipe 4 may be made of, for example, pure aluminum, aluminum alloy, pure copper, copper alloy, or stainless steel.

Figure 5B:
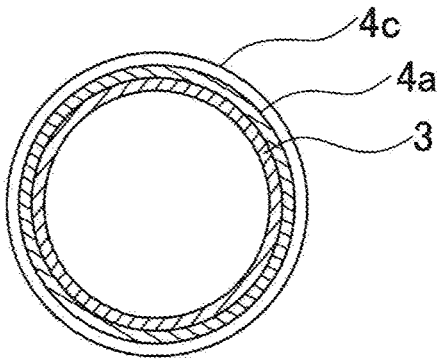

FIG. 5B is a view for illustrating a cross section cut along a line E-E shown in FIG. 5A. When the manufacturing method of the present invention is employed, as described above, outer circumferential portions where the corrugated portion 3*h* is not formed (i.e., where the element pipe is not processed) exist on the both end sides of the inner pipe 3. On this account, no special treatment for the inner pipe 3 is necessary for fixing the both end portions 4*a* and 4*b* of the outer pipe 4 to the inner pipe 3. This is a unique effect of the present invention. In addition to the above, the structure of the inner pipe 3 of the present invention (i.e., the structure in which a part where the corrugated portion 3*h* is selectively formed and a part where the element pipe is not processed and the corrugated portion 3*h* is not formed coexist) cannot be obtained by extrusion.

Figure 5C:
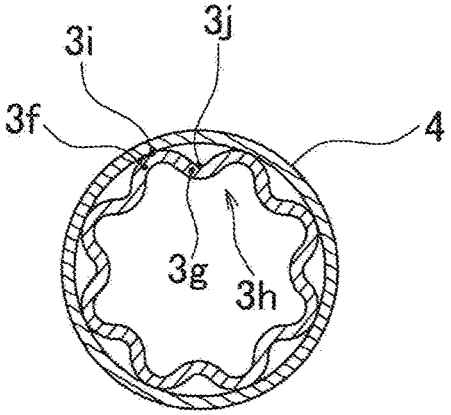

FIG. 5C is a view for illustrating a cross section cut along a line F-F shown in FIG. 5A. In a transverse cross section shown in FIG. 5C, eight outward protruding portions 3*f* and eight inward protruding portions 3*g* are provided in the circumferential direction. On this account, pressure drop of the flowing refrigerant is small and the bending processability of the double-walled pipe of the present invention is high. (In other words, the double-walled pipe is not broken when bended, and the cross sectional shape is stable.) The corrugated portion 3*h* may not be a combination of the eight outward protruding portions 3*f* and the eight inward protruding portions 3*g*. The portion may be suitably designed in accordance with customer's demands such as higher efficiency in heat exchange and lower pressure drop.

In the present embodiment, as shown in FIG. 5A and FIG. 5B, the outer pipe fixation step is performed in such a way that, after the both end portions 4*a* and 4*b* of the outer pipe 4 are radially fastened to the outer circumferential portion where the corrugated portion 3*h* is not formed in the inner pipe 3, the end portions are brazed or welded so as to be fixed. In this regard, the number of parts where the inner pipe 3 and the outer pipe 4 are fixed may be increased according to need. For example, fixation of the outer pipe may be achieved by a first method of inserting the inner pipe 3 into the outer pipe 4 by pressure, or by a second method of fixing the outer pipe 4 to the inner pipe 3 by crimping the outer pipe 4 from outside after the inner pipe 3 is inserted into the outer pipe 4. (In regard to the second method, the crimping may be performed across the entire length of the part where the corrugated portion 3*h* is formed, or may be intermittently performed at plural parts.)

<Modification 1>

The following will describe a modification 1 of the embodiment of the present invention. The modification 1 is different from the embodiment above in the structure of the metal movable claw. Members identical with those in the first embodiment described above will be denoted by the same reference numerals, and the explanations thereof may not be repeated.

FIG. 6A to FIG. 6D show a metal movable claw piece 102A of a metal movable claw 102 of the modification 1. As shown in FIG. 6A to FIG. 6D, the metal movable claw piece 102A has a leading end protruding portion 102*a* and a leading end projecting portion 102*p* projecting further radially outward from the leading end protruding portion 102*a*.

The leading end projecting portion 102*p* is formed at around the center in the axial direction (at around the center in the left-right direction of each of FIG. 6A and FIG. 6B) of the leading end protruding portion 102*a*.

Figure 6A:
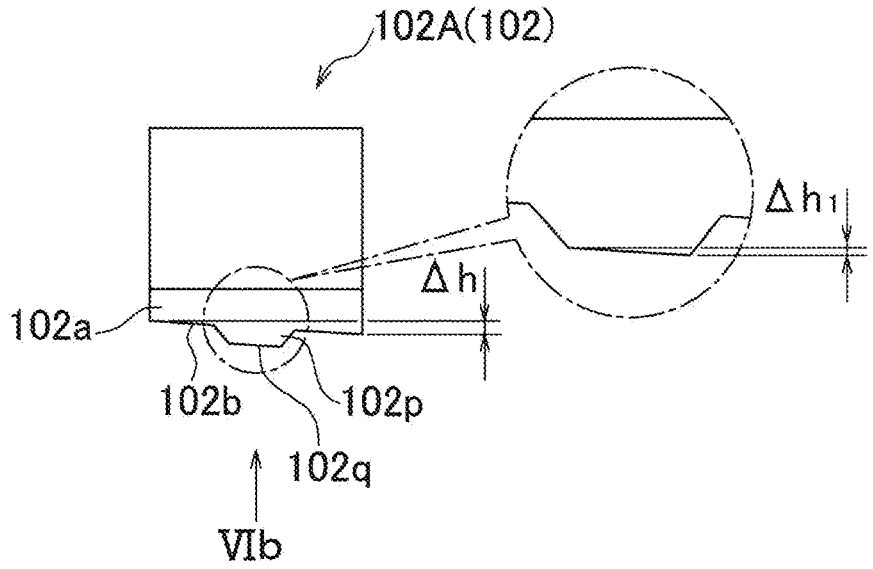
FIGS. 6A to 6D relate to a method for manufacturing a double-pipe heat exchanger of a modification 1.
Figure 6B:
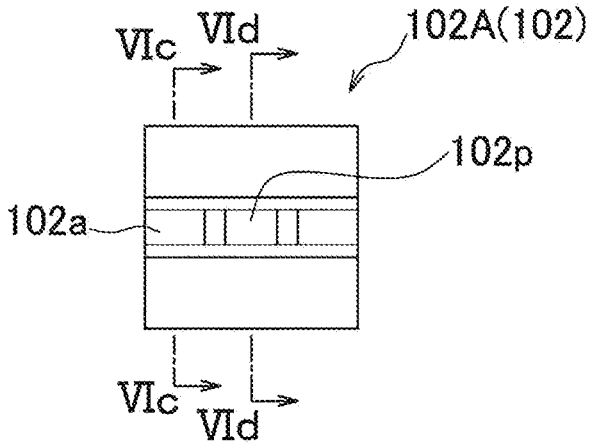
Figure 6C:
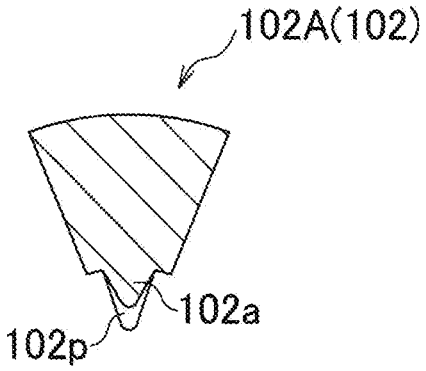
Figure 6D:
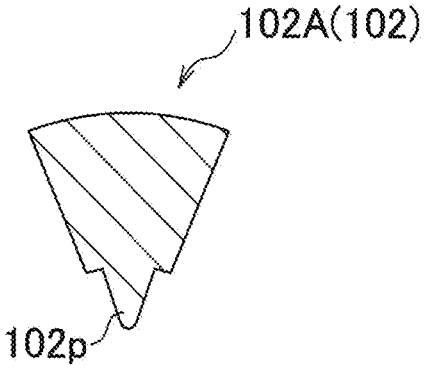

As shown in FIG. 6A and FIG. 6B, the leading end protruding portion 102*a* and the leading end projecting portion 102*p* extend in the axial direction of the metal movable claw 102. A ridgeline 102*b* extending in the axial direction of the leading end protruding portion 102*a* is slightly tilted relative to the axial direction as shown in FIG. 6A. For example, the ridgeline 102*b* of the leading end protruding portion 102*a* is tilted by Δh toward the side from which the inner pipe 3 is inserted (i.e., the right side in FIG. 6A). A ridgeline 102*q* extending in the axial direction of the leading end projecting portion 102*p* is slightly tilted relative to the axial direction as shown in FIG. 6A. For example, the ridgeline 102*q* of the leading end projecting portion 102*p* is tilted by Δh1 toward the side from which the inner pipe 3 is inserted (i.e., the right side in FIG. 6A).

Eight metal movable claw pieces constituting the metal movable claw 102 of the modification 1 are all identical with the metal movable claw piece 102A shown in FIG. 6A to FIG. 6D. Among the eight metal movable claw pieces constituting the metal movable claw 102 of the modification 1, at least one metal movable claw piece may be identical with the metal movable claw piece 102A shown in FIG. 6A to FIG. 6D. Furthermore, as a metal movable claw piece other than the metal movable claw piece 102A, the metal movable claw piece 2A shown in FIG. 1B to FIG. 1D may be employed.

In all steps from a designated section corrugated portion formation step 1 to a designated section corrugated portion formation step 3, the metal movable claw 102 of the modification 1 is used. Alternatively, the metal movable claw 102 of the modification 1 may be used in one or two of the steps from the designated section corrugated portion formation step 1 to the designated section corrugated portion formation step 3, and the metal movable claw 2 (see FIG. 1B) of the embodiment described above may be used in the remaining step.

The cored bar may be, for example, a cored bar which is arranged such that, in the recess 1*b* of the cored bar 1 of the embodiment above (see FIG. 1B), a part (see FIG. 6A) opposing the leading end projecting portion 102*p* of the metal movable claw 102 is further recessed radially inward.

With the metal movable claw 102 and the cored bar of the modification 1, at a part of the inner pipe pressed by the leading end projecting portion 102*p*, a protrusion protruding inward in the radial direction of the corrugated portion 3*h* (which is seen as a recess (not illustrated) when viewed from the outer surface of the inner pipe 3) is formed. This further increases the heat transfer area and improves the efficiency in heat exchange of the double-pipe heat exchanger.

While in the case above the ridgeline 102*b* of the leading end protruding portion 102*a* is slightly tilted relative to the axial direction as shown in FIG. 6A, the ridgeline 102*b* of the leading end protruding portion 102*a* may be in parallel to the axial direction. Furthermore, while in the case above the ridgeline 102*q* of the leading end projecting portion 102*p* is slightly tilted relative to the axial direction as shown in FIG. 6A, the ridgeline 102*q* of the leading end projecting portion 102*p* may be in parallel to the axial direction.

The description above deals with a case where the cored bar is arranged such that, in the recess 1*b* of the cored bar (see FIG. 1B), a part (see FIG. 6A) opposing the leading end projecting portion 102*p* of the metal movable claw 102 is further recessed radially inward. In this regard, alternatively, the cored bar may be arranged such that the part opposing the leading end projecting portion 102*p* of the metal movable claw 102 is not further recessed radially inward. For example, the cored bar 1 of the embodiment above may be used. Even when the cored bar 1 is used, a protrusion further protruding inward in the radial direction of the corrugated portion 3*h* is formed at a part of the inner pipe pressed by the leading end projecting portion 102*p* of the metal movable claw 102.

<Modification 2>

The following will describe a modification 2 of the embodiment of the present invention. The modification 2 is different from the embodiment above in the structure of the cored bar and the structure of the metal movable claw. Members identical with those in the first embodiment described above will be denoted by the same reference numerals, and the explanations thereof may not be repeated.

Figure 7A:
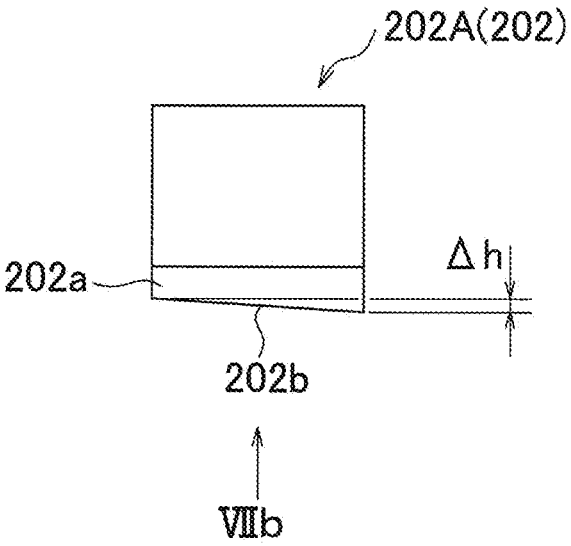
FIGS. 7A and 7B relate to a method for manufacturing a double-pipe heat exchanger of a modification 2.
Figure 7B:
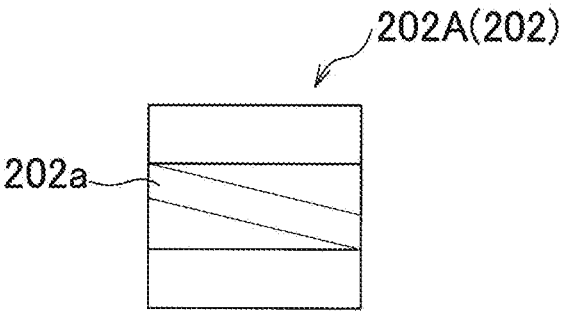

FIG. 7A and FIG. 7B show a metal movable claw piece 202A of a metal movable claw 202 of the modification 2. As shown in FIG. 7A, a leading end protruding portion 202*a* is formed at the metal movable claw piece 202A. As shown in FIG. 7B, the leading end protruding portion 202*a* is tilted relative to the axial direction of the metal movable claw 202 (i.e., the left-right direction in FIG. 7B). In FIG. 7A, a ridgeline 202*b* of the leading end protruding portion 202*a* is slightly tilted relative to the axial direction. For example, the ridgeline 202*b* is tilted by Δh toward the side from which the inner pipe 3 is inserted (i.e., the right side in FIG. 7A). The ridgeline 202*b* of the leading end protruding portion 202*a* may be in parallel to the axial direction.

Other metal movable claw pieces 202A constituting the metal movable claw 202 and other leading end protruding portions 202*a* of the metal movable claw 202 are identical with the metal movable claw piece 202A and the leading end protruding portion 202*a* shown in FIG. 7A and FIG. 7B.

The cored bar has eight protrusions 1*a* provided at equal intervals in the circumferential direction, as shown in FIG. 1B. Although not illustrated, each of the eight protrusions 1*a* is tilted relative to the axial direction of the cored bar. Each of the eight protrusions 1*a* extends in the same direction as the leading end protruding portion 202*a* of the metal movable claw 202 shown in FIG. 7B.

In the designated section corrugated portion formation step, the metal movable claw 202 is provided so that the leading end protruding portion 202*a* extending in a direction tilted relative to the metal movable claw 202 opposes the recess 1*b* extending in a direction tilted relative to the cored bar.

With the metal movable claw 202 and the cored bar (not illustrated) of the modification 2, it is possible to form the corrugated portion extending in a direction tilted relative to the axial direction in the first designated section 3*a*, the second designated section 3*b*, and the third designated section 3*c* of the inner pipe 3.

A method described below makes it possible to form, in the first designated section 3*a* and the second designated section 3*b*, a spiral-shaped corrugated portion that is uninterrupted and continuous.

After the designated section corrugated portion formation step 1 and the movable claw moving step 1, the cored bar is rotated about the axis (cored bar rotation step 1). In the inner pipe moving step 1, when the next second designated section 3*b* is moved to between the cored bar and the metal movable claw 202 so that the second designated section 3*b* overlaps the first designated section 3*a* in the axial direction, a part of the second designated section 3*b* overlapping the first designated section 3*a* in the axial direction (i.e., a part where a corrugated portion extending in a tilted direction has already been formed in the first designated section 3*a*) is arranged to extend along the eight protrusions 1*a* having been rotated in the cored bar rotation step 1 and extending in a direction tilted relative to the cored bar. The designated section corrugated portion formation step 2 is performed in this state. As a result, a spiral-shaped continuous corrugated portion is formed in the first designated section 3*a* and the second designated section 3*b*. The cored bar rotation step 1 may be performed before or after the inner pipe moving step 1. The cored bar rotation step 1 and the inner pipe moving step 1 may be simultaneously performed.

A method described below makes it possible to form, in the second designated section 3*b* and the third designated section 3*c*, a spiral-shaped corrugated portion that is uninterrupted and continuous.

After the designated section corrugated portion formation step 2 and the movable claw moving step 2, the cored bar is rotated about the axis (cored bar rotation step 2). In the inner pipe moving step 2, when the next third designated section 3*c* is moved to between the cored bar and the metal movable claw 202 so that the third designated section 3*c* overlaps the second designated section 3*b* in the axial direction, a part of the third designated section 3*c* overlapping the second designated section 3*b* in the axial direction (i.e., a part where a corrugated portion extending in a tilted direction has already been formed in the second designated section 3*b*) is arranged to extend along the eight protrusions 1*a* having been rotated in the cored bar rotation step 2 and extending in a direction tilted relative to the cored bar. The designated section corrugated portion formation step 3 is performed in this state. As a result, a spiral-shaped continuous corrugated portion is formed in the second designated section 3*b* and the third designated section 3*c*. The cored bar rotation step 2 may be performed before or after the inner pipe moving step 2. The cored bar rotation step 2 and the inner pipe moving step 2 may be simultaneously performed.

As a result of these steps, a spiral-shaped corrugated portion is uninterruptedly and continuously formed in the entirety of the predetermined range having the length L of the inner pipe 3. This further increases the heat transfer area and improves the efficiency in heat exchange of the double-pipe heat exchanger having the corrugated portion.

The modification 2 described above may be modified as described in the modification 3, for example.

<Modification 3>

The following will describe a modification (modification 3) of the modification 2 of the present invention. The modification 3 is different from the modification 2 above in the structure of the metal movable claw. Members identical with those in the modification 2 described above will be denoted by the same reference numerals, and the explanations thereof may not be repeated.

Figure 8A:
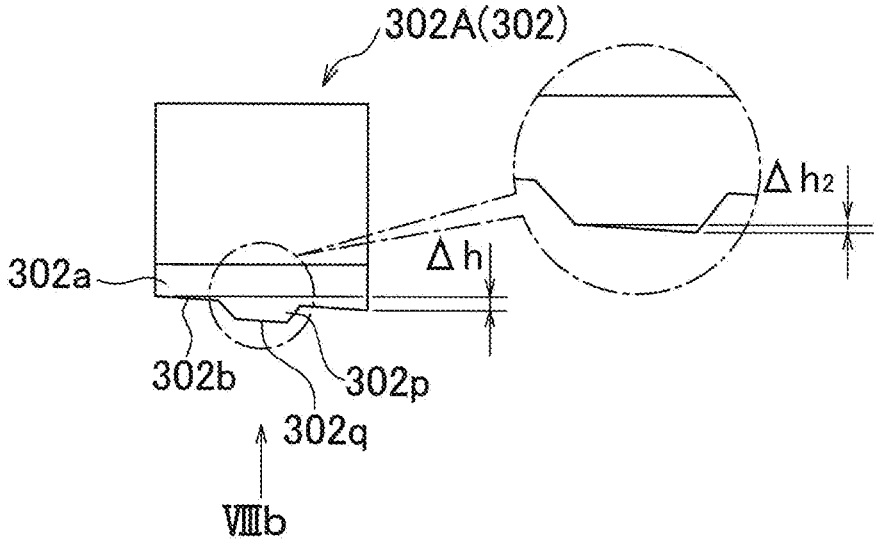
FIGS. 8A and 8B relate to a method for manufacturing a double-pipe heat exchanger of a modification 3.
Figure 8B:
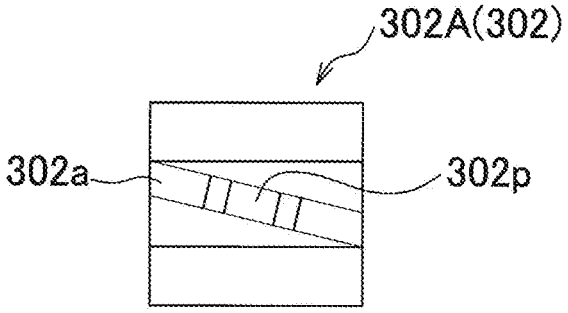

FIG. 8A and FIG. 8B show a metal movable claw piece 302A of a metal movable claw 302 of the modification 3. As shown in FIG. 8A, the metal movable claw piece 302A has a leading end protruding portion 302*a* and a leading end projecting portion 302*p* projecting further radially outward from the leading end protruding portion 302*a*. The leading end projecting portion 302*p* is formed at around the center in the axial direction (at around the center in the left-right direction of each of FIG. 8A and FIG. 8B) of the leading end protruding portion 302*a*.

As shown in FIG. 8B, the leading end protruding portion 302*a* and the leading end projecting portion 302*p* extend in a direction tilted relative to the axial direction of the metal movable claw 302. As shown in FIG. 8A, a ridgeline 302*b* of the leading end protruding portion 302*a* is slightly tilted relative to the axial direction. For example, the ridgeline 302*b* is tilted by Δh toward the side from which the inner pipe 3 is inserted (i.e., the right side in FIG. 8A). A ridgeline 302*q* of the leading end projecting portion 302*p* is slightly tilted relative to the axial direction as shown in FIG. 8A. For example, the ridgeline 302*q* is tilted by Δh2 toward the side from which the inner pipe 3 is inserted (i.e., the right side in FIG. 8A). The ridgeline 302*b* of the leading end protruding portion 302*a* may be in parallel to the axial direction. The ridgeline 302*q* of the leading end projecting portion 302*p* may be in parallel to the axial direction.

Eight metal movable claw pieces constituting the metal movable claw 302 of the modification 3 are all identical with the metal movable claw piece 302A shown in FIG. 8A and FIG. 8B. Among the eight metal movable claw pieces constituting the metal movable claw 302 of the modification 3, at least one metal movable claw piece may be identical with the metal movable claw piece 302A shown in FIG. 8A FIG. 8B. Furthermore, as a metal movable claw piece other than the metal movable claw piece 302A, the metal movable claw piece 202A shown in FIG. 7A FIG. 7B may be employed.

In all steps from a designated section corrugated portion formation step 1 to a designated section corrugated portion formation step 3, the metal movable claw 102 of the modification 1 is used. Alternatively, the metal movable claw 302 of the modification 3 may be used in one or two of the steps from the designated section corrugated portion formation step 1 to the designated section corrugated portion formation step 3, and the metal movable claw 202 (see FIG. 7A and FIG. 7B) of the modification 2 described above may be used in the remaining step.

The cored bar may be, for example, a cored bar which is arranged such that, in the recess 1*b* of the cored bar of the modification 2 (see FIG. 1B), a part (see FIG. 8A) opposing the leading end projecting portion 302*p* of the metal movable claw 302 is further recessed radially inward.

With the metal movable claw 302 of the modification 3, a corrugated portion extending in a direction tilted relative to the axial direction is formed in the inner pipe, and at a part of the inner pipe pressed by the leading end projecting portion 302*p*, a protrusion protruding inward in the radial direction of the corrugated portion (which is seen as a recess (not illustrated) when viewed from the outer surface of the inner pipe 3) is formed. This further increases the heat transfer area and improves the efficiency in heat exchange of the double-pipe heat exchanger.

While in the case above the ridgeline 302*b* of the leading end protruding portion 302*a* is slightly tilted relative to the axial direction as shown in FIG. 8A, the ridgeline 302*b* of the leading end protruding portion 302*a* may be in parallel to the axial direction. While in the case above the ridgeline 302*q* of the leading end projecting portion 302*p* is slightly tilted relative to the axial direction as shown in FIG. 8A, the ridgeline 302*q* of the leading end projecting portion 302*p* may be in parallel to the axial direction.

The description above deals with a case where the cored bar is arranged such that, in the recess 1*b* of the cored bar (see FIG. 1B), a part (see FIG. 8A) opposing the leading end projecting portion 302*p* of the metal movable claw 302 is further recessed radially inward. In this regard, the cored bar may be arranged such that the part opposing the leading end projecting portion 302*p* of the metal movable claw 302 is not further recessed radially inward. For example, the cored bar of the modification 2 above may be used. Even when the cored bar of the modification 2 is used, a protrusion further protruding inward in the radial direction of the corrugated portion 3*h* is formed at a part of the inner pipe pressed by the leading end projecting portion 302*p* of the metal movable claw 302.

In the embodiment above and the modifications 1 to 3, the corrugated portion 3*h* is formed in the predetermined range with the length L of the inner pipe 3 though three groups of steps. The disclosure, however, is not limited to this arrangement. For example, the corrugated portion 3*h* may be formed through two groups of steps or through four or more groups of steps. For example, when the corrugated portion 3*h* is formed in a predetermined range that is long and has a length L of 400 to 500 mm, the above-described steps from the designated section corrugated portion formation step to the inner pipe moving step are repeated accordingly. In other words, the corrugated portion 3*h* can be formed in a predetermined range having a desired length L.

In the embodiment above, for example, as shown in FIG. 1C, the ridgeline 2*b* of the leading end protruding portion 2*a* of the metal movable claw 2 is tilted by Δh relative to the axial direction. Alternatively, the ridgeline 2*b* of the leading end protruding portion 2*a* of the metal movable claw 2 may be in parallel to the axial direction.

In the embodiment above, as shown in FIG. 1C, the ridgeline 2*b* of the leading end protruding portion 2*a* of the metal movable claw 2 is tilted by Δh toward the side from which the inner pipe 3 is inserted (i.e., the right side in FIG. 1C). Alternatively, the ridgeline 2*b* of the leading end protruding portion 2*a* of the metal movable claw 2 may be tilted by Δh toward the side opposite to the side from which the inner pipe 3 is inserted (i.e., the left side in FIG. 1C). With this metal movable claw 2, each protrusion (which is seen as a recess (not illustrated) when viewed from the outer surface of the inner pipe 3) is more prominent at each of the part where the first designated section 3*a* and the second designated section 3*b* are overlapped and the part where the second designated section 3*b* and the third designated section 3*c* are overlapped. On this account, it is more evident that the corrugated portion of the inner pipe is formed by the method for the present embodiment, and not formed by another method (e.g., rolling).

Likewise, in the modification 1, the ridgeline 102*b* (see FIG. 6A) of the leading end protruding portion 102*a* of the metal movable claw 102 may be tilted by Δh toward the side opposite to the side from which the inner pipe 3 is inserted (i.e., left side in FIG. 6A). In the modification 1, the ridgeline 102*q* (see FIG. 6A) of the leading end projecting portion 102*p* may be tilted by Δh1 toward the side opposite to the side from which the inner pipe 3 is inserted (i.e., left side in FIG. 6A).

Likewise, in the modification 2, the ridgeline 202*b* (see FIG. 7A) of the leading end protruding portion 202*a* of the metal movable claw 202 may be tilted by Δh toward the side opposite to the side from which the inner pipe 3 is inserted (i.e., left side in FIG. 7A).

Likewise, in the modification 3, the ridgeline 302*b* (see FIG. 8A) of the leading end protruding portion 302*a* of the metal movable claw 302 may be tilted by Δh toward the side opposite to the side from which the inner pipe 3 is inserted (i.e., left side in FIG. 8A). In the modification 3, the ridgeline 302*q* (see FIG. 8A) of the leading end projecting portion 302*p* may be tilted by Δh2 toward the side opposite to the side from which the inner pipe 3 is inserted (i.e., left side in FIG. 8A).

By suitably changing a combination of a shape of the cored bar 1 and a shape of the metal movable claw 2 of the present invention, it is possible to set the efficiency in heat exchange and the pressure drop in various manners.

In the embodiment above and the modifications 1 to 3, the corrugated portion 3*h* is formed at equal intervals in the axial direction. The disclosure, however, is not limited to this arrangement. For example, the corrugated portion 3*h* may be formed at irregular intervals in the axial direction. In such a case, the inner pipe 3 is moved in accordance with the irregular intervals.

In the embodiment above and the modifications 1 to 3, the corrugated portion 3*h* is formed in the predetermined range with the length L of the inner pipe 3 though three groups of steps. The disclosure, however, is not limited to this arrangement. As a matter of course, for example, the corrugated portion 3*h* may be formed in the predetermined range of the inner pipe 3 through a single group of steps. In this case, a metal movable claw 2 which is long enough to form the corrugated portion 3*h* in the predetermined range through a single groups of steps and a cored bar 1 corresponding to that claw 2 are required.

The embodiment above and the modifications 1 to 3 employ the cored bar 1 having the eight protrusions 1*a* and the metal movable claw 2 having the eight leading end protruding portions 2*a*. The disclosure, however, is not limited to this arrangement. For example, it is possible to employ a cored bar 1 having an even number of protrusions 1*a* and a metal movable claw 2 having leading end protruding portions 2*a* that are identical in number with the protrusions 1*a*. For example, it is possible to employ a cored bar 1 having four or six protrusions 1*a* and a metal movable claw 2 having leading end protruding portions 2*a* that are identical in number with the protrusions 1*a*.

When an even number of protrusions 1*a* of a cored bar 1 are provided at equal intervals in the circumferential direction and the same number of leading end protruding portions 2*a* of a metal movable claw 2 are provided at equal intervals in the circumferential direction, for example, as shown in FIG. 2B and FIG. 2C, two protrusions 1*a* provided on the opposite sides of the cored bar 1 in the radial direction about the axis protrude radially outward away from each other. Furthermore, two leading end protruding portions 2*a* provided on the opposite sides of the metal movable claw 2 in the radial direction about the axis protrude radially inward away from each other. With this arrangement, when the inner pipe 3 is pressed inward by the metal movable claw 2, the inner pipe 3 is pressed radially inward from the opposite sides by the two leading end protruding portions 2*a* that are provided on the opposite sides in the radial direction about the axis. On this account, the cross sectional shape of the inner pipe 3 is maintained to be substantially circular, while the corrugated portion 3*h* is formed on the inner pipe 3.

It is therefore possible to manufacture the inner pipe 3 that have the corrugated portion 3*h* and is substantially cylindrical in shape.

In the modifications 1 to 3, the number of the protrusions of the cored bar and the number of the leading end protruding portions of the metal movable claw are not limited to any particular numbers. For example, being similar to the above, it is possible in the modifications 1 to 3 to employ a cored bar having an even number of protrusions and a metal movable claw having leading end protruding portions that are identical in number with the protrusions.

The embodiment of the present invention thus described above solely serves as a specific example of the present invention, and is not to limit the scope of the present invention. The specific structures and the like are suitably modifiable. Further, the effects described in the embodiment of the present invention are no more than examples of preferable effects brought about by the present invention, and the effects of the present invention are not limited to those described hereinabove.

REFERENCE SIGNS LIST

1 cored bar
1*a* protrusion
1*b* recess
2, 102, 202, 302 metal movable claw
2A, 102A, 202A, 302A metal movable claw piece
2*a*, 102*a*, 202*a*, 302*a* leading end protruding portion
2*b*, 102*b*, 102*q*, 202*b*, 302*b*, 302*q* ridgeline
3 inner pipe
3*a* first designated section
3*b* second designated section
3*c* third designated section
3*f* outward protruding portion
3*g* inward protruding portion
3*h* corrugated portion
3*i* top portion
3*j* bottom portion
4 outer pipe
4*a*, 4*b* end portion
4*c*, 4*d* expanded pipe portion
102*p*, 302*p* leading end projecting portion

The invention claimed is:

1. A method for manufacturing a double-pipe heat exchanger which includes an outer pipe and an inner pipe provided inside the outer pipe and which has a corrugated portion in which, in a transverse cross section of the inner pipe, outward protruding portions protruding radially outward and inward protruding portions protruding radially inward are alternately formed in a circumferential direction, the method comprising:

an inner pipe insertion step of inserting the inner pipe in an axial direction by a predetermined length to between (i) a cored bar which has at least one protrusion pointing radially outward at a position corresponding to a top portion of the corrugated portion and has a predetermined length in the axial direction and (ii) a metal movable claw which has at least one leading end protruding portion pointing radially inward at a position corresponding to a bottom portion of the corrugated portion, is radially movable, and has a predetermined length in the axial direction; and a corrugated portion formation step of forming the corrugated portion in a predetermined range of the inner pipe in the axial direction by pressing the inner pipe radially inward by the metal movable claw and plastically deforming the inner pipe, wherein, in the corrugated portion formation step, until the corrugated portion is formed in entirety of the predetermined range, (1) a designated section corrugated portion formation step of forming the corrugated portion in a designated section in the predetermined range of the inner pipe by pressing the designated section radially inward by the metal movable claw having a designated length shorter than the predetermined range of the inner pipe and plastically deforming the designated section, (2) a movable claw moving step of moving, after the step (1), the metal movable claw having the designated length radially outward of the inner pipe, and (3) an inner pipe moving step of moving, after the step (2), a next designated section to between the cored bar and the metal movable claw so that the next section designated next in the predetermined range overlaps the designated section of the step (1) are repeated in this order, and wherein, a ridgeline of a leading end protruding portion of the metal movable claw having the designated length is tilted relative to the axial direction.

2. The method for manufacturing the double-pipe heat exchanger according to claim 1, further comprising an outer pipe fixation step of radially fastening both end portions of the outer pipe to axial outer circumferential portions which are in vicinity of both ends of the predetermined range and where the corrugated portion is not formed, and then fixing the end portions by brazing or welding.

3. The method for manufacturing the double-pipe heat exchanger according to claim 2, wherein, the cored bar includes four, six, or eight protrusions that are provided at equal intervals in the circumferential direction, and the metal movable claw includes leading end protruding portions that are provided at equal intervals in the circumferential direction and are identical in number with the protrusions.

4. The method for manufacturing the double-pipe heat exchanger according to claim 1, wherein, the cored bar includes four, six, or eight protrusions that are provided at equal intervals in the circumferential direction, and the metal movable claw includes leading end protruding portions that are provided at equal intervals in the circumferential direction and are identical in number with the protrusions.

* * * * *